United States Patent [19]

Taguchi et al.

[11] 4,350,523

[45] Sep. 21, 1982

[54] POROUS IRON ORE PELLETS

[75] Inventors: Kazumasa Taguchi, Amagasaki; Hiroshi Isako, Kobe; Koichi Ikeda, Kakogawa; Keisuke Honda, Kasai; Masaru Kanemoto, Kakogawa; Keishiro Hanaoka, Kobe, all of Japan

[73] Assignee: Kabushiki Kaisha Kobe Seiko Sho, Kobe, Japan

[21] Appl. No.: 138,407

[22] Filed: Apr. 8, 1980

[30] Foreign Application Priority Data

Apr. 12, 1979 [JP] Japan ..... 54/45109
Aug. 28, 1979 [JP] Japan ..... 54/110079

[51] Int. Cl.[3] ..... C22B 1/14
[52] U.S. Cl. ..... 75/0.5 R; 75/5
[58] Field of Search ..... 75/0.5 R, 256, 3–5; 264/111, 117

[56] References Cited

U.S. PATENT DOCUMENTS 3,189,436 6/1965 Burstlein ..... 75/5
4,231,797 11/1980 Fujita ..... 75/256

FOREIGN PATENT DOCUMENTS 2121520 11/1972 Fed. Rep. of Germany ..... 75/3

OTHER PUBLICATIONS

*JIS M8716–1971* "Methods for Measuring . . . Pellets", Translated and Published by Japanese Standards Association, pp. 1–3, (1973).
*JIS M8716–1977* "Methods for Measuring . . . Pellets", Published by Japanese Standards Association, pp. 1–3, 1 (1980).

*Primary Examiner*—Michael L. Lewis
*Attorney, Agent, or Firm*—Oblon, Fisher, Spivak, McClelland & Maier

[57] ABSTRACT

Porous iron ore pellets and a process for manufacturing same, the pellets having a pore size distribution consisting of more than 30% of pores having a diameter greater than 10 microns and a balance of pores having a diameter smaller than 10 microns, a total porosity greater than 30%, and an FeO content less than 1% by weight.

5 Claims, 5 Drawing Figures

POROUS IRON ORE PELLETS

BACKGROUND OF THE INVENTION

This invention relates generally to porous iron ore pellets, and more particularly to iron ore pellets, which are, in addition to possession of the properties which are required for a burden material of a blast furnace, improved in particular in reducibility, properties at high temperatures such as softening and sticking, repose angle, non-flowability into a coke layer, compressive strength, and a process for producing such iron ore pellets.

In a case where a large quantity of pellets is charged into a blast furnace, it is considered to be difficult to stabilize the blast furnace operation at a high level as compared with a case using sinter. This tendency is gathered to be attributable to the spherical shape, small repose angle due to high density and softening and sticking properties of the pellets. The pellets are apt to segregate at the center of the furnace when charged through the furnace top. In addition, the pellets which are in contact with adjacent pellets only at one point are inferior in the power of retaining a layer and therefore the pellet layer easily disintegrate in the stage of burden descending disturbing the distribution of burden materials and of gas flow. Further, the pellets are inferior to sinter in softening and sticking properties.

Various studies have thus far been made in an attempt to obtain pellets of improved properties and shape which ensure stable furnace operation even when the pellets are used in a large amount. For example, self-fluxing pellets with improved reducibility and physical strength and MgO-containing self-fluxing pellets with improved softening and sticking properties have been proposed and put into practice.

The MgO-containing self-fluxing pellets have relatively good reducibility at high temperatures but not as good as that of sinter for the reasons discussed below.

As the pellets descend in a blast furnace, they are subjected to higher temperatures undergoing reduction with a gas which diffuses into fine pores of the pellets, reducing iron oxide into FeO and then into Fe. In this instance, a slag containing FeO and having a low melting point is produced within the pellets in the high temperature zone. The low melting point slag produced in the high temperature zone exudes and clogs the fine pores of the pellets, causing the phenomenon which is generally referred to as "retardation of reduction".

With the self-fluxing pellets containing MgO, the slag contains MgO and thus has a higher melting point so that the exudation of the slag and clogging of pores are lessened. However, the adverse effects of the slag is unignorable since the pores have very small diameters.

The clogging of pores hinders the reduction from proceeding in a sufficient degree within the pellets. Upon entering the high temperature zone, the pellets which bear the FeO containing slag soften and contract to increase the permeability resistance of the iron ore pellet layer and at the same time the pellets melt and boil by direct contact with a coke layer of high temperature, imparing the permeability of the coke layer and hindering smooth operation of the furnace.

The reducibility of the pellets (the so-called retardation of reduction) in the high temperature zone can be improved effectively by increasing the porosity and pore diameters of the individual pellets. The increase of the porosity of iron ore pellets can contribute to improvement in reducibility in the regions leading to the high temperature zone, namely, to the decrease of the amount of FeO in the high temperature zone, while the increases in pore diameter contribute to the improvement of reducibility and to lessening the clogging of pores by the low melting point slag.

The porosity and pore diameter can be increased by:

(a) Lowering the firing temperature; and (b) Adding a combustible material.

When the firing temperature is lowered, the porosity is increased as indicated by curve 4 of FIG. 2 but the pore diameter becomes smaller, with a lower physical strength due to insufficient sintering of the internal structure. Therefore, the pellets soften and contract to a considerable degree unsuitable for practical use.

A method for producing porous pellets by adding a combustible material is disclosed, for example, in Japanese Laid-Open Patent Specifications 119403/1977 and 10313/1978, each using a material combustible at a relatively high temperature. The pellets obtained by these methods have pores of large diameters but are unsuitable for actual use in a blast furnace for the following reasons.

(1) The pellets are susceptible to cracking and have a low compressive strength due to a large FeO content;

(2) The use of a high carolific material causes excessive slagbonding and retards reduction after FeO; and (3) The pore diameters are too large to retain a suitable compressive strength.

For subsequent pelletization, the combustible material to be blended into iron ore should be ground into a particle size smaller than 2 mm. When the combustible material is admixed in an amount of 0.5 to 8% by weight, particles of about 2 mm in diameter are apt to form cores in the pelletizing stage. Therefore, in a case where the combustible material contains coarse particles in a great proportion, core-like particles are abnormally increased during the pelletizing operation in a pelletizer (e.g., disc or drum type pelletizer), causing a shortage of finer particles which are necessary for the growth of the cores, namely, hindering the growth of pellets or sometimes making the pelletization almost impossible. Even if somehow pelletized into desired sizes, the resulting pellets bear coarse particles on the outer peripheral surfaces or contains dumplings of agglomerated coarse particles which lower the productivity of green pellets of appropriate sizes or cause various problems in the subsequent firing stage. For example, the coarse core-like particles easily come off the pellet surfaces and the dumplings of agglomerated coarse particles readily disintegrate in the firing stage, causing clogging of the grate by deposition or production of an increased amount of dust which is deleterious to the efficiency of operation and the service life of the firing equipment. In addition, the coarse particles lower the yield to a considerable degree.

Further, the existence of coarse particle makes it difficult to admix the combustible material uniformly with iron ore and to maintain a uniform porosity over the individual pellets. Another difficulty attributable to coarse particles is that drop resistance of green pellets which are blended with the combustible material including coarse particles is as low as 50 to 60% of that of green pellets which the combustible material is not added. Such a large fall of the drop resistance is considered to be attributable solely to the inclusion of coarse particles in the pellets. As a result, the green pellets easily crack or break into smaller pieces even when conveyed from a pelletizer to a firing apparatus, reducing the yield of pellets to a considerable degree.

In order to solve these problems, there should be employed a combustible material which contains coarse particles in as small a proportion as possible and which is ground to have a grain or particle size smaller than 2 mm, preferably, smaller than 0.5 mm.

The above-mentioned combustible materials are generally extremely low in crushability, for example, the grinding work index Wi (JIS M 4002) of sawdust is as high as about 600 kwh/t in contrast to Wi of iron ore which is 6–25 kwh/t or to Wi of petroleum coke which is about 70 kwh/t. Moreover, there is a possibility of dust explosion when a combustible material alone is forcibly pulverized and it is difficult to completely preclude the danger of explosion by employing ordinary explosion-proof measures.

SUMMARY OF THE INVENTION

With the foregoing in view, the present inventors conducted a comprehensive study with an object of obtaining pellets which are more improved in reducibility and softening and sticking properties and in particular which have large pores in a porosity of greater than 30% along with a uniform quality and a sufficient compressive strength, and succeeded in achieving this object by determining specific ranges of the grain size, distribution and additive amount of the combustible material to be blended with ore and the conditions of firing subsequent to the pelletizing stage.

More particularly, the gist of the present invention resides in: on a dry basis adding to iron ore 0.5 to 8% by weight of a combustible material having a grain size smaller than 2 mm, preferably, smaller than 0.5 mm and inflammable at a temperature lower than 400° C.; further adding thereto suitable amounts of a binder and water; pelletizing the resulting mixture; preliminary firing the pellets to burn off at least 90% by weight of the combustible material before the preliminary firing temperature reaches 800° C.; thereby forming pores in the pellets; and further firing the preliminarily fired pellets at a temperature of 1230° to 1350° C.

The porous iron-ore pellets according to the present invention have a pore size distribution consisting of more than 30% of pores with a diameter larger than 10 microns and a balance of pores with a diameter smaller than 10 microns, a porosity of higher than 30%, and an FeO content of less than 1% by weight.

The above and other objects, features and advantages of the invention will become apparent from the following description and the appended claims, taken in conjunction with the accompanying drawings.

PARTICULAR DESCRIPTION OF THE INVENTION

Figure 1:
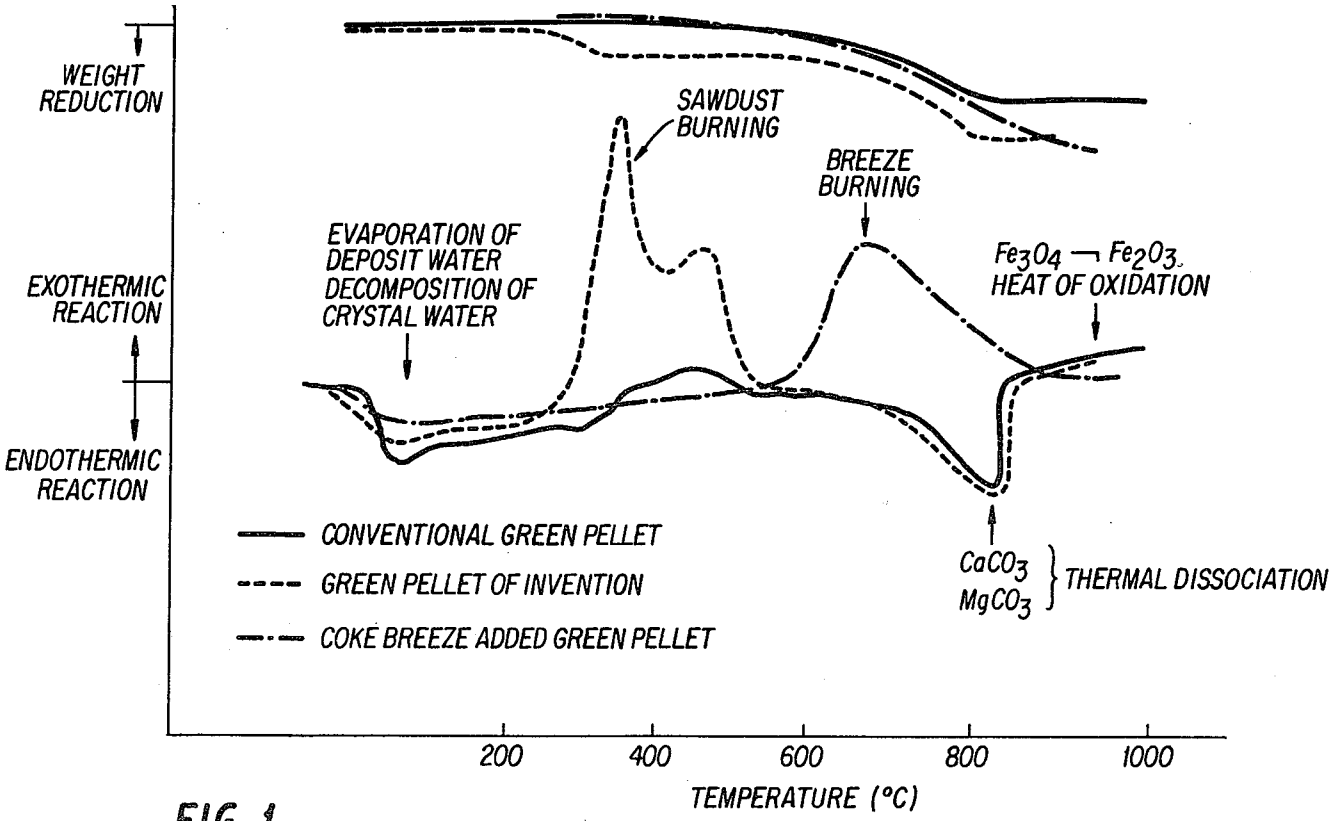
FIG. 1 is a chart showing the results of differential thermal analysis.

The porous iron-ore pellets according to the present invention have a porosity larger than 30%, and a pore size distribution consisting of more than 30% of pores having a diameter greater than 10 microns and a balance of pores having a diameter smaller than 10 microns to ensure a reducibility far greater than that of the conventional pellets. In particular, a porosity greater than 30% is essential in order to obtain a high reducibility as intended by the present invention.

The above-mentioned range of pore size distribution is determined for the following reasons. For maintaining a satisfactory compressive strength, it is effective to suppress the FeO content to a value below 1% by weight and to minimize the pore diameter. However, a pore size distribution containing small pores in a greater proportion is substantially contrary to the object of preventing pore clogging (retardation of reduction).

In addition, the pellets of the invention with a high porosity have a bulk density smaller than that of conventional pellets of the same composition by more than 10%, so that they are more tardy to flow into the coke layer, encouraging the permeability of the reducing gas and the central gas flow in the furnace to reduce troubles of the furnace operation to a minimum.

As mentioned hereinbefore in connection with the prior art, fired pellets with a higher porosity have insufficient compressive strength and easily break into particles in handling or in the furnace, resulting in causing various troubles in the blast furnace operation. In the present invention, this problem is solved by suppressing the FeO content in the pellets to a value smaller than 1% by weight.

The decrease of the FeO content in pellets lowers the degree of the bond of brittle slag in the pellet structure but strengthens the bond of hematite, maintaining a sufficient compressive strength in spite of the high porosity.

Thus, in the porous pellets of the invention, the internal porosity and pore size distribution are defined in particular ranges and the FeO content is suppressed to a value, to ensure high reducibility and excellent softening and sticking properties while maintaining a high compressive strength.

In the present invention, a suitable amount of CaO may be added to iron ore of raw material to adjust the basicity ($CaO/SiO_2$) to 0.7 to 2 thereby to impart self-fluxing property and at the same time to increase reducibility all the more. Moreover, 0.5 to 2.5% by weight of MgO may be blended into the raw material to improve the softening and sticking properties at high temperatures.

The use of combustible material of a particular form is essential to the formation of pores in the pellets in the above-defined porosity and size. The combustible material to be used in the present invention should be in the form of particles having a grain size smaller than 2 mm, preferably, smaller than 0.5 mm and be inflammable at a temperature lower than 400° C. The just-defined range of grain size is determined for securing a pore size distribution which will enhance the reducibility of the ultimate pellets to a maximum degree and from the standpoint of the pelletizing operation which will enhance the efficiency of pellet production. However, the grain size is preferred to be greater than 50 microns since otherwise the pore size distribution of the ultimate pellets will be biased to smaller diameters. On the contrary, combustible material of large grain sizes alone will result in a pore size distribution which is biased to larger diameters and thus in a lower compressive strength of the ultimate pellets. In addition, grain sizes exceeding the above-defined range will result in a poor pelletizing efficiency of the combustible material.

The inflammable temperature of the combustible material should be lower than 400° C. in order to form pores within the pellets at a relatively low firing temperature and to secure a high compressive strength even with a high porosity. Namely, with a combustible material of a low inflammable temperature, the firing starts at a relatively low temperature and completes within a short time period, facilitating the formation of pores and encouraging diffusion of oxygen to accelerate oxidation of magnetite. If a combustible material of a high inflammable temperature is used, the firing proceeds at a high temperature, at which $Fe_2O_3$ in the pellets is reduced to produce the aforementioned low melting point slag containing FeO, lowering the compressive strength and impairing the reducibility. Examples of suitable combustible material include brown coal (flash point: 312° C.), sawdust (flash point: 342° C.) and the like. Coke which has an inflammation point at about 550° C. is unsuitable for use in the present invention.

The combustible material should be added in an amount of 0.5 to 8% by weight on the basis of iron ore of the raw material for controlling the porosity to the above-defined range. An additive amount less than 0.5% by weight is too small to increase the total porosity to a suifficient degree.

On the other hand, an additive amount of combustible material in excess of 8 wt % lowers the compressive strength of the pellets due to a too high total porosity and advances the reduction of $Fe_2O_3$ by a high calorific value, producing an increased amount of FeO and lowering the reducibility of the pellets. Further, additive amounts exceeding the above-defined range considerably impairs the pelletizing efficiency.

In the present invention, in order to obtain combustible material of intended grain sizes, uncrushed or coarsely crushed combustible material may be blended into iron ore for dry mixed grinding in a grinder such as a ball or rod mill. The mixed grinding allows smooth and efficient pulverization of the combustible material by the following functions.

(1) When the combustible material is ground by the impact and friction of the grinding medium such as ball or rod, iron ore acts as a wedge or auxiliary grinding medium which assists the grinding operation, drastically improving the grinding efficiency.

(2) The combustible material is selectively pulverized by the auxiliary grinding actions of iron ore which suppresses excessive grinding while diluting the combustible material to preclude the possibilities of dust explosion.

(3) The combustible material is mixed uniformly with iron ore in the grinding stage to ensure uniform porosity of ultimately produced pellets.

These effects were confirmed by a number of experiments in which sawdust and iron ore or iron sand were pulverized by both solitary and mixed grinding for comparative purposes under the following conditions.

Grinding Conditions

Grinding System: Dry Batch System
Mill Size: 165 mmϕ×170 mml (ball mill)
Revolution: 60 r.p.m.
Time: 20 minutes
Ball Charge: 43 balls of 30 mmϕ and 9.87 kg

EXPERIMENT 1:

Sample 1: 0.26 l (57.5 g) of sawdust alone
Sample 2: 0.52 l (1325.8 g) of iron ore alone
Sample 3: A mixture of 0.26 l (57.5 g) of sawdust and 0.26 l (651.8 g) of iron ore

Figure 5:
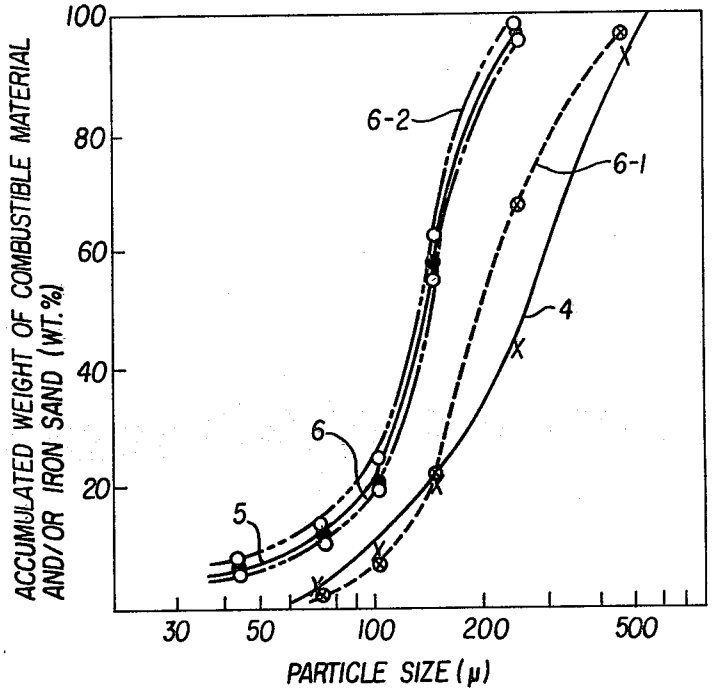
FIGS. 4 and 5 are graphs plotting particle size distributions by solitary and mixed grinding.
Figure 4:
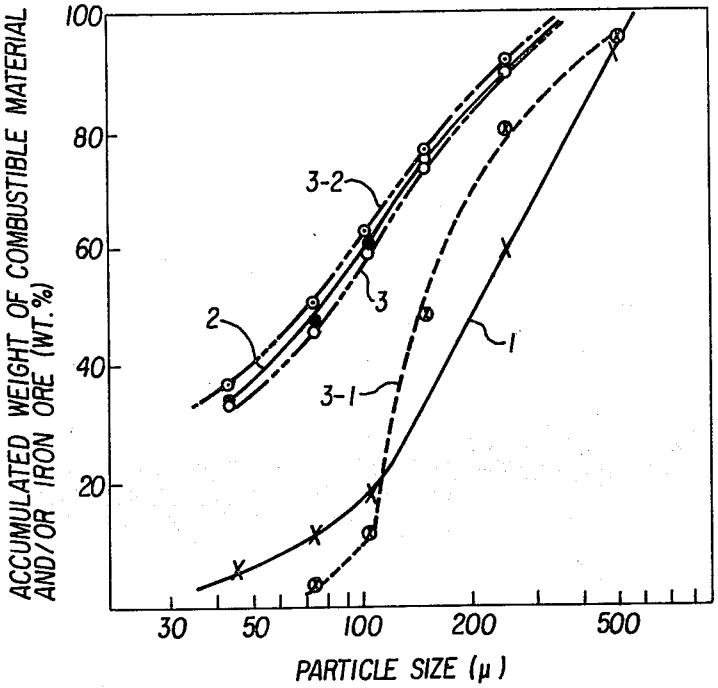

EXPERIMENT 2:

Sample 4: 0.26 l (50 g) of sawdust alone
Sample 5: 0.52 l (1395 g) of iron sand alone
Sample 6: A mixture of 0.26 l (50 g) of sawdust and 0.26 l (725 g) of iron sand The results of the foregoing EXPERIMENTS 1 and 2 are shown in FIGS. 4 and 5, respectively. In FIG. 4, plotted at 3-1 is the particle size distribution of sawdust separated from the mixed Sample 3 and at 3-2 the particle size distribution of similarly separated iron ore. Plotted at 6-1 of FIG. 5 is the particle size distribution of sawdust separated from the mixed Sample 6 and at 6-2 the size distribution of similarly separated iron sand.

As clear from the results of experiments shown in FIGS. 4 and 5, sawdust of the solitary grinding (Samples 1 and 4) still contains a large particles in an unignorable amount due to insufficient grinding, in contrast to sawdust of mixed grinding with iron ore or iron sand (Sample 3 and 6) which is pulverized in the same sufficient degree as in solitary grinding of iron ore or iron sand (Samples 2 and 5). It will be understood from comparison of Samples 1 and 3-1 of FIG. 4 or Samples 4 and 6-1 of FIG. 5 that sawdust pulverized by mixed grinding with iron ore or iron sand contains ultra-fine particles in a far reduced amount as compared with sawdust of solitary grinding, due to the above-mentioned selective grinding effect which supresses excessive grinding. This and the diluting effect of iron ore or iron sand suitably preclude the possibilities of dust explosion.

In addition, the mixed grinding serves to narrow the particle size distribution to the intended range for uniformalizing the diameters of pores to be formed in pellets.

In a case where the ground mixture of combustible material and iron ore is classified by a pneumatic classifier of closed circuit system, the combustible material and iron ore can be classified at different points due to a difference in specific gravity. A classifying point for iron ore of about 100μ corresponds to sawdust of 300 to 400μ, petroleum coke of 160 to 190μ, coal of 170 to 200μ, and rubber of 210 to 270μ. By this mixed grinding, the combustible material can also be ground into particle sizes suitable for pelletization. It may also be mentioned that in this case excessive grinding of the combustible material can be avoided since it has a higher classifying point due to a smaller specific gravity.

In the present invention, a predetermined amount of the combustible material is blended into iron ore of the raw material, if necessary, along with CaO and MgO for imparting the self-fluxing property, and the resulting mixture is added with suitable amounts of a binder and water, followed by kneading and pelletization.

The pellets thus obtained are preliminarily fired to burn off at least 90% of the combustible material in the pellets before a preliminary firing temperature reaches 800° C. If the combustible material is burned off at a high temperature, it acts as a reducing agent and lends itself to the production of an increased amount of FeO by reduction of $Fe_2O_3$, lowering the compressive strength as well as the reducibility of the pellets. However, if the combustible material is burned off at a temperature lower than 800° C., the reduction of $Fe_2O_3$ is suppressed to maintain the amount of FeO at a percentage less than 1%, as a result ensuring a high compressive strength for the pellets and improving the degree of oxidation for a higher reducibility.

The porous pellets resulting from the preliminary firing are further fired raising the temperature until a final temperature level of 1230° to 1350° C. is reached. This firing strengthens the iron oxide bond between the individual iron ore particles in the case of acid pellets and further the bond of the CaO containing slag in the case of self-fluxing pellets, finally adjusting various properties of pellets in appropriate ranges. If the firing temperature is lower than 1230° C., it becomes difficult to achieve the above-mentioned objects and the resulting fired pellets have a lower quality due to insufficient firing. On the other hand, a firing temperature higher than 1350° C. melts and destructs part of the pores which have been expressly formed in the preceding stage and causes thermal dissociation to part of $Fe_2O_3$, producing FeO in an increased amount to lower the compressive strength of the pellets. Therefore, the firing temperature should be in the above-defined range.

The invention is illustrated more particularly by the following Example.

EXAMPLE 75 parts by weight (parts and percentages appearing in this example are parts and percentages by weight unless otherwise indicated) of iron oxide containing small blocks of iron ore was blended with lime stone and dolomite in such amounts that the final pellets would have a basicity ($CaO/SiO_2$) of 1.35 and a MgO content of 1.8%, and crushed in a closed circuit system, storing the raw material thus prepared in a blending silo. The feed of raw material from the silo feeder was added with a suitable amount of water and kneaded in a pug mill, and then mixed with 25 parts of magnetite ore, 4 parts of sawdust of predetermined particle sizes (with a size distribution as shown in Table 1 below) and 0.8 parts of bentonite serving as a binder, in a drum mixer, adding water to adjust the water content in the cake. The resulting cake was pelletized by a disc type pelletizer.

TABLE 1

| | Sawdust Particle Size Distribution | | | | | |
|---|---|---|---|---|---|---|
| Particle Size (mm) | 2–1 | 1–0.5 | 0.5–0.25 | 0.25–0.1 | 0.1–0.5 | Average Size (mm) |
| Percentage | 4 | 23 | 51 | 14 | 8 | 0.45 |

The green pellets thus obtained were preliminarily fired on a grate, more particularly, were dried, dehydrated and preheated (the preliminary firing temperatures were 180° C. in the drying chamber, 400° C. in the dehydrating chamber and 1050° to 1150° C. in the preheating chamber). The physical properties of the green and preliminarily fired pellets are shown in Table 2.

As clear from FIG. 1 which shows differential thermal analysis of the invention, coke breeze adding method and conventional green pellets, the sawdust was burned off in the vicinity of 510° C. in contrast to the breeze which still remained unburned at a temperature over 900° C.

The experiments were conducted in the atmosphere at a heating speed of 10° C./min. However, in actual industrial operations, the heating speed is generally 50° to 100° C./min and the oxygen concentration is 13 to 18%, so that the plots are presumably shifted slightly to the higher temperature side. Nevertheless, since the C-content in the preliminarily fired pellets is decreased to a level as in the conventional ones as shown in Table 2, the added sawdust is considered to have been burned off in a relatively low temperature range. The physical properties of the pellets which are added with an equivalent amount of coke in place of sawdust and of the pellets obtained by the conventional method are shown also in Table 2 below.

TABLE 2

| | Physical Properties of Green Pellets and Preliminarily Fired Pellets | | | | | |
|---|---|---|---|---|---|---|
| | | | Preliminarily Fired Pellets | | | |
| | Green Pellets | | Compressive Strength (kg/Pellet) | | | |
| | Drop Resistance (times) | Porosity (%) | | Porosity (%) | FeO—Content (%) | C—Content (%) |
| Sawdust Added Pellets (Invention) | 20.5 | 33.2 | 19.0 | 48.3 | 0.62 | <0.1 |
| Coke Added Pellets (Comparative | 20.0 | 28.0 | 18.0 | 44.8 | 3.65 | 0.9 |
| Conventional Pellets | 35.0 | 30.0 | 24.0 | 34.0 | 25.0 | <0.1 |

The conventional pellets referred to in Table 2 are MgO added self-fluxing pellets (dolomite pellets) with a composition as shown in Table 5 and the coke added pellets of a similar composition are further added with coke powder in an amount of 4 wt % prior to pelletization and firing.

The preliminarily fired pellets were subjected to a further firing in a rotary kiln at 1315° C. and, after cooling by an annular cooler, fine particles were screened out. The physical properties, pore size distribution and chemical composition of the pellets thus obtained are shown in Tables 3 to 5.

Figure 2:
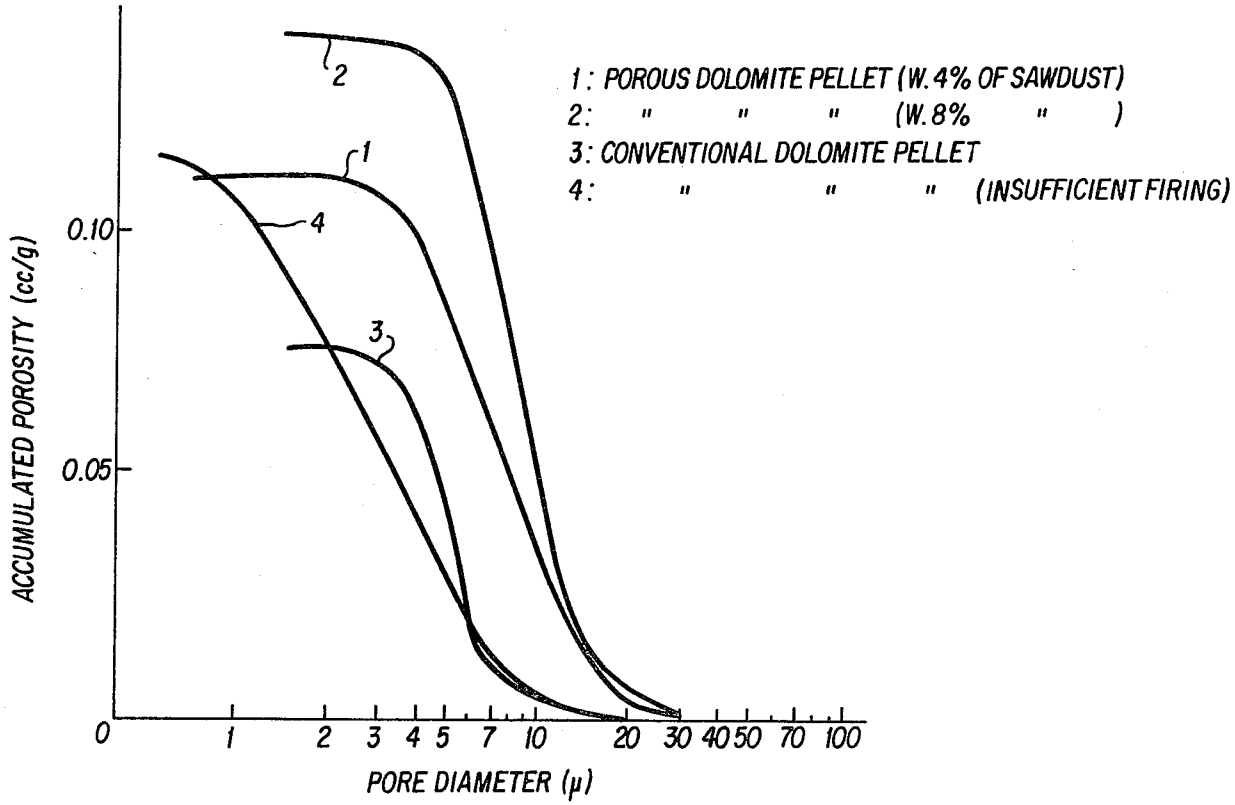
FIG. 2 is a graph showing pore size distributions.

FIG. 2 graphically shows pore size distributions of pellets 1 and 2 according to the present invention, from which it will be seen that the pellets of the invention have distinctively increased pore diameter, and absolute amount of pores as compared with the conventional dolomite pellets 3.

Figure 3:
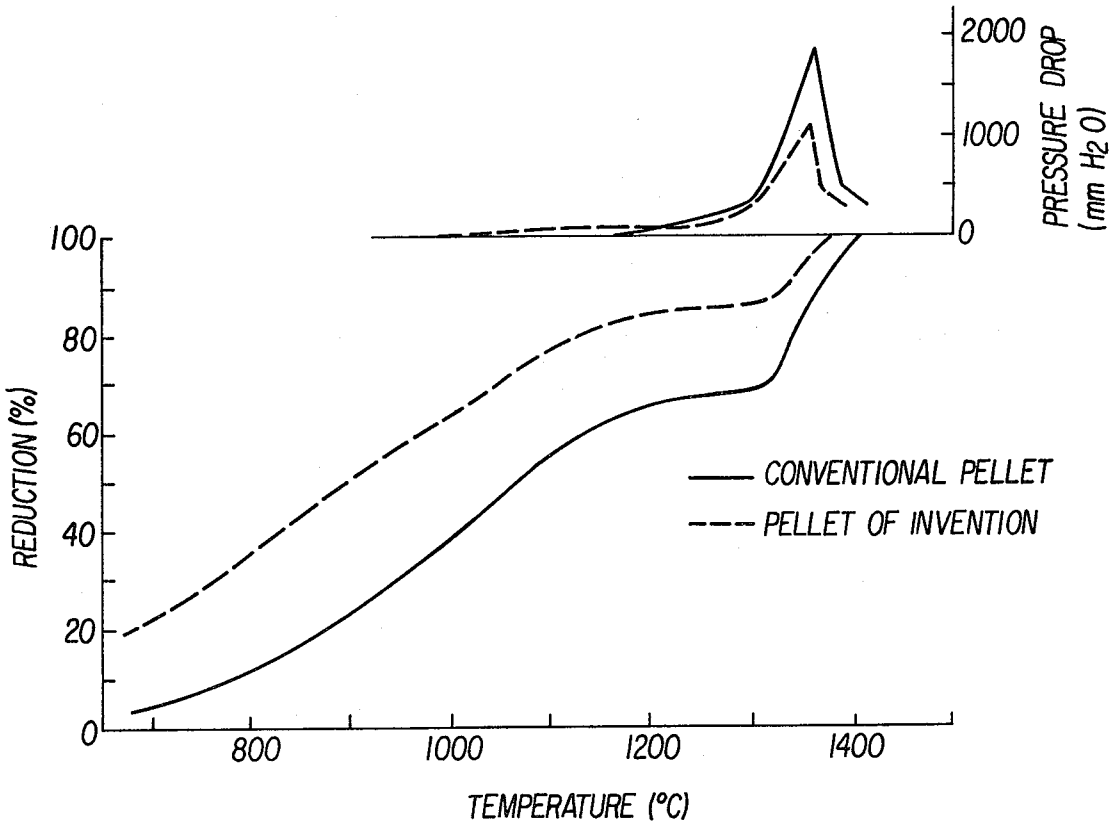
FIG. 3 is a graph showing the results of reduction test under load.

As seen in FIG. 3 which shows the results of reduction test under load up to melting, the pellets of the invention are prominently improved in maximum pressure drop and reducibility as compared with conventional pellets. The reduction test was conducted under the following conditions.

Heating Speed: 10° C./min up to 1000° C. 5° C./min above 1000° C.

Feed Gas: $N_2$:CO=70:30 (7.2 Nl/min)

Load: 1.0 kg/cm$^2$

TABLE 3

| | Properties of Pellets | | | | | | |
|---|---|---|---|---|---|---|---|
| | | | | | Reduction* under Load at 1100° C. | | |
| | Compressive Strength (kg/Pellet) | Porosity (%) | Bulk Density | Swelling Index (%) | Contraction Ratio (%) | Reduction Rate (%) | JIS Reduction Rate (%) |
| Sawdust Added Pellets (Invention) | 230 | 34.9 | 1.8 | 8.4 | 8.0 | 91.2 | 92.3 |
| Coke Added Pellets (Comparative) | 114 | 27.0 | 2.1 | 3.5 | 11.4 | 69.7 | 71.3 |
| Conventional Pellets | 320 | 24.0 | 2.2 | 8.0 | 5.0 | 80.0 | 82.5 |

*Feed Gas: $N_2$:CO = 70:30 (15 Nl/min.), Load: 2 kg/cm$^2$

TABLE 4

| | Pore Size Distribution | | | | | |
|---|---|---|---|---|---|---|
| | Pore Size (μ) | | | | | |
| | <5 | 5-6 | 6-7 | 7-10 | 10-100 | 100-3000 |
| Sawdust Added Pellets (Invention) | 20 | 13 | 10 | 18 | 39 | 0 |
| Coke Added Pellets (Comparative) | 22 | 12 | 11 | 16 | 18 | 21 |
| Conventional Pellets | 23 | 42 | 21 | 9 | 5 | 0 |

TABLE 5

| | Chemical Composition | | | | | | |
|---|---|---|---|---|---|---|---|
| | Total Fe | FeO | $SiO_2$ | $Al_2O_3$ | CaO | MgO | CaO/$SiO_2$ |
| Sawdust Added Pellets (Invention) | 60.0 | 0.40 | 4.0 | 1.60 | 5.40 | 1.82 | 1.35 |
| Coke Added Pellets (Comparative) | 61.0 | 3.25 | 3.9 | 1.50 | 5.30 | 1.80 | 1.36 |
| Conventional Pellets | 60.1 | 0.50 | 4.0 | 1.57 | 5.40 | 1.85 | 1.35 |

As clear from the data given in Tables 3 to 5 and FIGS. 2 and 3, the pellets of the invention (sawdust added pellets) have pores of large diameters in a high porosity, a decreased amount of FeO, excellent reducibility and softening and sticking properties along with a compressive strength which is suitable for use in a blast furnace.

On the other hand, the comparative pellets using coke instead of sawdust have pores of large diameters but contain FeO in an extremely increased amount and a low compressive strength, showing reducibility and softening and sticking properties even inferior to conventional products.

Table 6 below shows the results of actual operations in which the pellets of the present invention were charged into a blast furnace along with lump ore, replacing the conventional pellets in different proportions.

TABLE 6

| | Results of Actual Operations | | | |
|---|---|---|---|---|
| | Proportions of Sawdust Added Pellets (%) | | | |
| | 0 | 25 | 35 | 75 |
| Production (ton/day) | 1107 | 1154 | 1142 | 1219 |
| Coke Rate (kg/ton) | 491 | 465 | 458 | 445 |
| Oil Rate (kg/ton) | 35 | 32 | 35 | 31 |
| Fuel Rate (kg/ton) | 525 | 497 | 483 | 476 |
| Corrected Fuel Rate (kg/ton) | 529 | 504 | 495 | 475 |
| Blast Volume (Nm$^3$/min) | 1002 | 998 | 998 | 999 |
| Blast Pressure/volume | 1.18 | 1.08 | 1.06 | 0.99 |
| Ore/Coke | 3.07 | 3.20 | 3.31 | 3.41 |
| Slips (times/day) | 26.0 | 7.0 | 6.7 | 4.8 |
| Hanging (times/day) | 0.4 | 0 | 0.14 | 0 |
| Fluctuations in Blast Pressure (g/cm$^2$/h) | 502 | 502 | 472 | 355 |

As clear from the results of Table 6, with a greater proportion of the pellets of the present invention, the coke and fuel rates are reduced to a considerable degree, at the same time reducing the number of times of the slips and the fluctuations in blast pressure to ensure a higher stability of operation. In addition, the productivity is also enhanced, increasing the production by about 10%.

What is claimed is:

1. Porous iron ore pellets, which are obtained by admixing to iron ore a combustible material having a grain size smaller than 2 mm and inflammable at a temperature below 400° C., pelletizing the resulting mixture and burning off said combustible material, said iron ore pellets having a pore size distribution consisting of more than 30% of pores having a diameter of 10 microns to 100 microns and a balance of pores having a diameter smaller than 10 microns, a total porosity greater than 30%, and an FeO content less than 1%.

2. Porous iron ore pellets of claim 1, wherein said pellets have a basicity (CaO/$SiO_2$) of 0.7 to 2.

3. Porous iron ore pellets of claim 1 or 2, wherein said pellets are blended with 0.5 to 2.5% by weight of MgO.

4. Porous iron ore pellets of claim 1, wherein said combustible material is admixed in an amount 0.5 to 8% by weight of said iron ore on dry basis.

5. Porous iron ore pellets of claim 1, wherein said combustible material has a grain size smaller than 0.5 mm.

* * * * *

UNITED STATES PATENT AND TRADEMARK OFFICE

CERTIFICATE OF CORRECTION

PATENT NO. : 4,350,523

DATED : September 21, 1982

INVENTOR(S) : KAZUMASA TAGUCHI ET AL

It is certified that error appears in the above—identified patent and that said Letters Patent is hereby corrected as shown below:

Column 1, line 25, delete "disintegrate" and insert --disintegrates--;

line 53, delete "is" and insert --are--; and line 62, correct the spelling of "impairing".

Column 2, line 48, delete "contains" and insert --contain--;

line 60, delete "particle" and insert --particles--; and line 67, after "pellets", insert --to--.

Column 3, line 42, delete "preliminary" and insert --preliminarily--.

Column 4, line 31, delete "resulting in".

Column 5, line 40, delete "impairs" and insert --impair--.

Column 6, line 23, delete "a".

Column 7, line 20, delete "destructs" and insert --destroys--; and line 33, correct the spelling of "limestone".

UNITED STATES PATENT AND TRADEMARK OFFICE

CERTIFICATE OF CORRECTION

PATENT NO. : 4,350,523 Page 2 of 2

DATED : September 21, 1982

INVENTOR(S) : KAZUMASA TAGUCHI ET AL

It is certified that error appears in the above—identified patent and that said Letters Patent is hereby corrected as shown below:

Column 8, line 34, after "parative", insert --)--.

Signed and Sealed this

*First* Day of *February 1983*

[SEAL]

*Attest:*

GERALD J. MOSSINGHOFF

*Attesting Officer* *Commissioner of Patents and Trademarks*

Disclaimer 4,350,523.—*Kazumasa Taguchi*, Amagasaki; *Hiroshi Isako*, Kobe; *Koichi Ikeda*, Kakogawa; *Keisuke Honda*, Kasai; *Masaru Kanemoto*, Kakogawa and *Keishiro Hanaoka*, Kobe, Japan. POROUS IRON ORE PELLETS. Patent dated Sept. 21, 1982. Disclaimer filed Dec. 9, 1986, by the assignee, *Kabushiki Kaisha Kobe Seiko Sho.*

Hereby enters this disclaimer to the entire remaining term of said patent.
[*Official Gazette February 17, 1987.*]